US005277517A

United States Patent [19]

McClellan

[11] Patent Number: 5,277,517

[45] Date of Patent: Jan. 11, 1994

[54] MOBILE COFFERDAM

[75] Inventor: Byron K. McClellan, Salem, Ind.

[73] Assignee: The United States of America as represented by the Secretary of the Army, Washington, D.C.

[21] Appl. No.: 757,370

[22] Filed: Sep. 10, 1991

[51] Int. Cl.[5] ..... E02D 23/02

[52] U.S. Cl. ..... 405/13; 405/195.1; 405/203; 405/205

[58] Field of Search ..... 405/11-14, 195.1, 205

[56] References Cited

U.S. PATENT DOCUMENTS

| | | | |
|---|---|---|---|
| 480,127 | 8/1892 | O'Rourke | 405/11 X |
| 916,859 | 3/1909 | Gilman | 405/11 X |
| 924,362 | 6/1909 | Leow | 405/13 |
| 946,841 | 1/1910 | Gilman | 405/11 |
| 1,098,961 | 6/1914 | Mosher | 405/136 |
| 1,182,446 | 5/1916 | Barber | 405/11 |
| 2,705,403 | 4/1955 | Ebert | 405/13 |
| 3,335,572 | 8/1967 | Tsujioka | 405/14 |
| 3,830,068 | 8/1974 | Peter | 405/11 |
| 4,386,872 | 6/1983 | Smith | 405/13 |

FOREIGN PATENT DOCUMENTS

| | | | |
|---|---|---|---|
| 2616464 | 12/1988 | France | 405/11 |
| 165716 | 9/1984 | Japan | 405/13 |
| 29625 | 2/1987 | Japan | 405/11 |

*Primary Examiner*—Randolph A. Reese
*Assistant Examiner*—John Ricci
*Attorney, Agent, or Firm*—Luther A. Marsh

[57] ABSTRACT

A mobile cofferdam for use in the construction of elongated structures within a body of water is characterized by a water-tight rectangular shell which is guided and supported off the previously constructed segment of the sill or wall structure being built. The mobile cofferdam shell is floated into place, sunk, dewatered, and used as a cofferdam during construction of the sill. The mobile cofferdam is guided and supported off the previous placed concrete sill or wall and proceeds in a horizontal slip-form fashion. The walls of the mobile cofferdam are designed as spaced truss structures with skin plate on the inner, outer, top and bottom surface thereof to define a chamber which can be filled or evacuated with water to float the shell structure. The trailing end of the shell conforms to the sill or wall under construction and includes seals along the contact area for mating with the previously constructed sill portion.

9 Claims, 2 Drawing Sheets

MOBILE COFFERDAM

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

The present invention relates to a mobile cofferdam and to a method for building elongated structures in a body of water using the mobile cofferdam. In accordance with the invention, construction of the elongated structure takes place in a dewatered or still water enclosure. The method of construction is most applicable to a long, repetitive structure such as a concrete sill or massive wall to be built within the body of water.

BRIEF DESCRIPTION OF THE PRIOR ART

Typically, major construction within the river, lake, or other body of water is performed inside a cofferdam of cellular sheet pile cells and granular fill. These conventional cofferdams are costly and time consuming to build. Their construction is subject to delay and cost increases arising from unknown foundation conditions at the bottom of the body of water, from unpredictable weather and water conditions, and from difficult dewatering problems.

In addition, these structures require movement and placing of massive quantities of material to fill the sheet pile cells and stabilizing berms where required. Following construction, this same material must then be degraded and spoiled in order to remove the cofferdam, which disturbs the surrounding environment.

SUMMARY OF THE INVENTION

Accordingly, it is a primary object of the present invention to provide a mobile cofferdam structure for use in building elongated sills or walls on the bottom of a body of water. The cofferdam includes a rectangular shell having spaced inner and outer walls which define a first chamber between the walls and a second chamber within the interior of the shell. A bottom wall is connected with the bottom edges of the inner and outer walls for closing the bottom of the first chamber. A pump is connected with the shell for controlling the water depth within the first and second chambers. Thus, when water is removed from the second chamber, a construction area for building a segment of the sill or other elongated structure is defined. When water is removed from the first chamber, the shell is floated for repositioning with respect to a previously built segment of the sill. The shell also includes an anchoring mechanism for anchoring the shell to the previously built portion of the sill.

According to a more specific embodiment of the invention, one side wall of the shell is contoured to match the contour of the sill under construction. In this fashion, the cofferdam can be positioned in sealing relation along the contoured side wall with the previously constructed segment of the sill, and anchored thereto, with construction of the next segment of the sill taking place within the second chamber of the shell.

A further object of the invention is to provide a method for building elongated structures in a body of water. In accordance with the method, the mobile cofferdam is positioned at the bottom of a body of water.

Using the pump, water is removed from the interior of the cofferdam to define a dry working environment. Next, a segment of the sill is constructed within the cofferdam on the bottom of the body of water. Following construction, the interior of the cofferdam is flooded with water and the first chamber of the cofferdam is evacuated so that the cofferdam floats above the bottom of the body of water. Next, the cofferdam is repositioned laterally along the length of the previously constructed segment of the sill. The first chamber is again flooded whereby the cofferdam will sink into relation with the previously constructed sill segment. The cofferdam is then anchored to the segment and the next segment of the cofferdam is built.

The cofferdam is anchored in place either by using a hydraulic gripping mechanism which secures the cofferdam to the previously constructed sill segment, or by using the underwater Tremie placement method wherein concrete is delivered through a tube, the end of which is kept submerged in the fluid concrete mass. The weight of the concrete and/or foundation piles or temporary piles can be used to anchor the cofferdam in abutting relation with the existing sill segment.

BRIEF DESCRIPTION OF THE FIGURES

Other objects and advantages of the subject invention will become apparent from a study of the following specification when viewed in light of the accompanying drawing in which.

DETAILED DESCRIPTION

Figure 1:
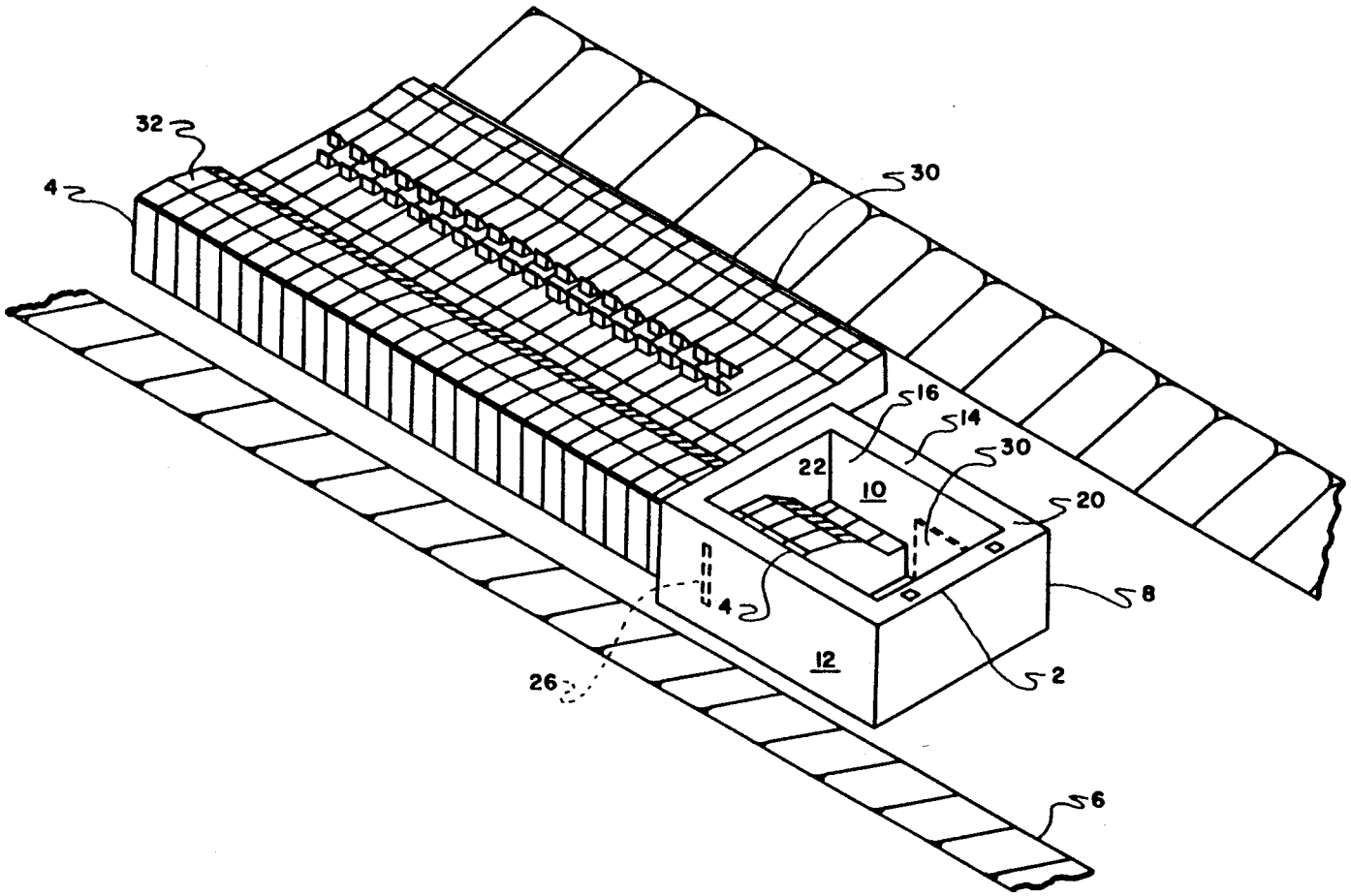
FIG. 1 is a perspective view of the mobile cofferdam for constructing an elongated sill within a body of water.

As shown in FIG. 1, the mobile cofferdam 2 is used for the construction of an elongated structure such as a sill 4 beneath a body of water. More particularly, the bottom of the body of water is first dredged out along the dredge lines 6 to define a channel in which the sill 4 is to be constructed. As will be developed in greater detail below, the sill is constructed in segments within the interior of the mobile cofferdam. After a segment of the sill has been completed, the cofferdam is repositioned laterally to define a working area for construction of one or more subsequent segments of the sill. The cofferdam is repositioned as many times as necessary so that the entire elongated sill can be constructed.

Figure 2:
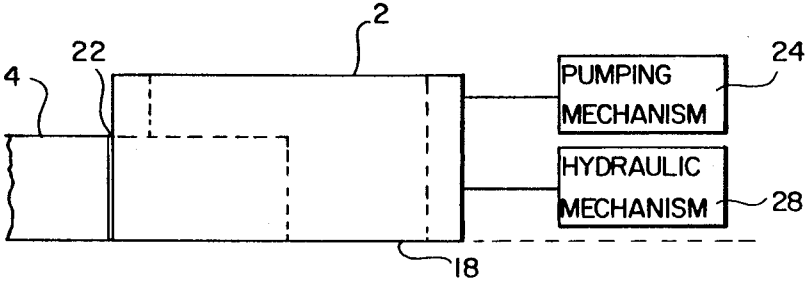
FIG. 2 is a front plan view of the cofferdam according to the invention.
Figure 3:
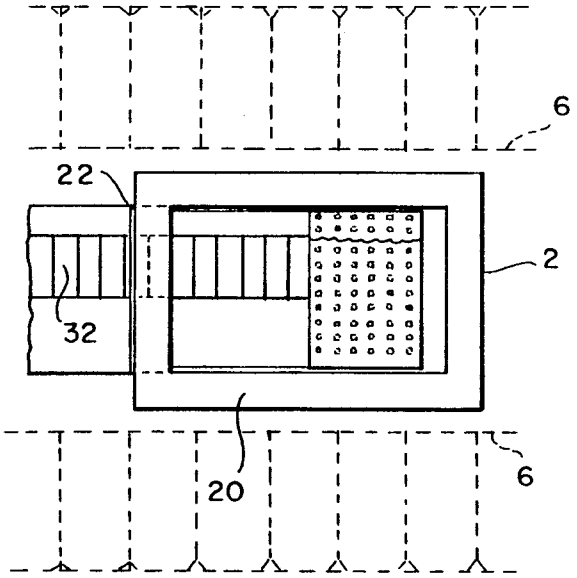
FIG. 3 is a top plan view of the mobile cofferdam of FIG. 2.

As shown in FIGS. 1–3, the mobile cofferdam comprises a rectangular shell 8 having spaced inner and outer walls 10, 12 which define a first chamber 14 between the walls and a second chamber 16 within the interior of the shell. For structural rigidity, the shell is preferably formed by space truss structures (not shown) with skin plates on the inner and outer surfaces thereof to define the inner and outer walls 10, 12, respectively. A bottom wall 18 (FIG. 2) is connected with the bottom edges of the inner and outer walls for closing the bottom of the first chamber. If desired, a top wall 20 may be provided for connection with the top edges of the inner and outer walls for closing the top of the first chamber as well. However, no walls are provided at the top and bottom of the second chamber 16, whereby the second chamber is open at both its top and bottom ends for placement over an existing portion of the sill, as will be set forth in greater detail below.

One side wall of the cofferdam shell is contoured along a line 22 to match the contour of the sill segment previously constructed. Preferably, this wall of the cofferdam shell is provided with a rubber gasket or seal to mate with the previously constructed sill segment, thereby preventing any leakage therethrough.

Figure 4:
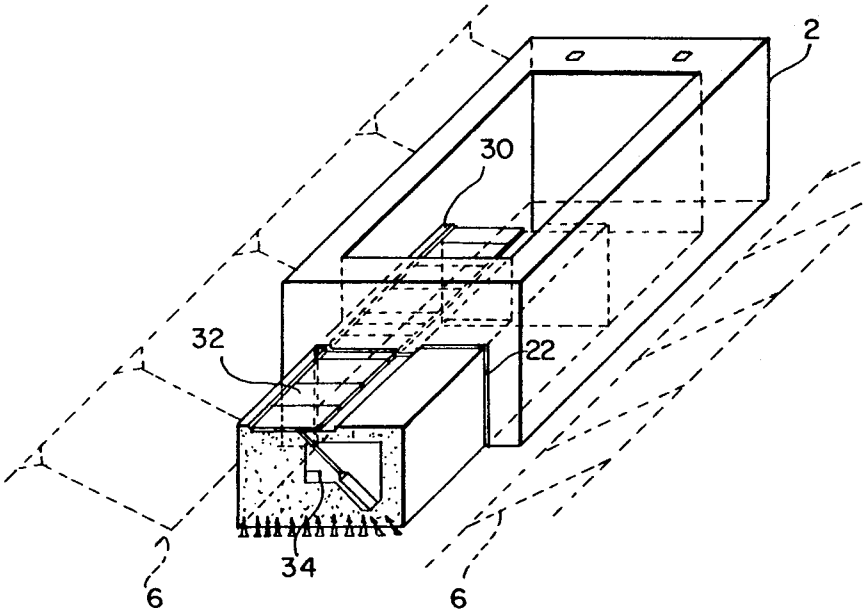
FIG. 4 is a partial sectional perspective view of cofferdam positioned for construction of a subsequent segment of the sill.

A pumping mechanism 24 is connected with the cofferdam shell for adding or removing water from the first and second chambers, respectively. Accordingly, when water is removed from the second chamber within the interior of the shell, a construction area for construction of a segment of the elongated sill is defined as shown in FIGS. 1 and 4. When water is removed from the first chamber between the inner and outer walls, the shell is floated for repositioning with respect to a previously built segment of the sill.

With the second chamber 16 filled with water and the first chamber 14 evacuated from water, the shell has a tendency to float in the body of water in which the sill is being constructed. By pumping water into the first chamber 14 between the inner and outer shell walls, the shell gradually sinks within the body of water. By using cables or other guide mechanisms, the mobile cofferdam shell can be accurately positioned on the bottom surface of the body of water. Next, the second chamber 16 can be evacuated using the pumping mechanism 4 to define a construction area free from water within which a sill segment can be constructed.

In order to anchor the mobile cofferdam shell in place, gripping jacks 26 are provided within the interior of the shell. Upon actuation of a hydraulic mechanism 28, the gripping jacks are extended into a pressing engagement with the previously constructed sill segment, thereby fixing the shell to the previously constructed sill segment, with the contoured rubber seal mating against the contour of the pre-existing sill segment.

Movable forms 30 are also connected with the cofferdam shell. These forms are positioned upon operation of the hydraulic mechanism 28 to define the outer surface of the sill segment to be constructed within the interior of the dewatered cofferdam shell. Next, steel is positioned within the forms following which concrete is poured within the form to construct the next sill segment. Once the concrete has cured, the forms 30 are removed from the newly constructed sill segment upon operation of the hydraulic mechanism 28, and the second chamber 16 is flooded by the pumping mechanism 24. Next, the grippers 26 are disengaged from the previously constructed sill segment, and water is removed from the first chamber 14 by the pumping mechanism 24 to re-float the mobile cofferdam. Using the guide mechanism (not shown) the mobile cofferdam is laterally shifted down along the length of the just completed sill segment and repositioned for construction of a further segment of the sill.

The mobile cofferdam shell may be quite large. For example, the shell may have an interior chamber 16 approximately 200 feet in length and of any suitable width, such as, for example, 50 feet so that long segments of a sill may be constructed at any particular time. This is necessary for the construction of complex sill structures including complex machinery for positioning movable wickets relative to the completed concrete sill.

The method for building elongated structures such as sills or walls within a body of water in accordance with the invention will now be described.

A special fixed cell is constructed to serve as a truss support for the mobile cofferdam for the first segment of sill to be constructed or to define a temporary end fill section which is necessary for the trailing end of the mobile cofferdam. This trailing end is the end of the sill which has a configuration conforming with the perimeter of the sill under construction. The initial section of the sill or wall is constructed inside the dewatered cofferdam. Once this is done, subsequent segments of the sill are constructed as set forth below. The mobile cofferdam is slightly floated by pumping water out of the first chamber 14 following which the cofferdam is advanced along a previously constructed sill segment. Next, the first chamber is flooded to sink the mobile cofferdam to the bottom of the body of water. The mobile cofferdam is then anchored to the previously constructed segment of the sill. This anchoring step may be performed in one of two ways. Preferably, the mobile cofferdam shell includes gripping members which are extendable from the shell for gripping grooves or other recesses provided in the sill. Alternatively, in accordance with the "Tremie" method, a thick (approximately 5 feet) layer of concrete is poured within the second chamber 16 of the shell. This concrete is poured by placing concrete through a tube or hose until the thick layer of concrete is formed on the floor of the body of water. If the interior wall of the cofferdam shell is tapered, it can be broken loose from the concrete base formed in the second chamber. However, this base prevents lateral displacement of the shell whereby the shell can only be moved vertically by floating the shell relative to the base, and then repositioning it laterally beyond the base.

With the mobile cofferdam anchored in place, the pumping mechanism is activated to dewater the interior of the shell. The pumping mechanism can comprise a dewatering system which is installed around the perimeter of the mobile cofferdam. Once the second chamber of the cofferdam shell has been dewatered, forms can be positioned to define the contour of the sill under construction. Concrete is poured into the forms to physically construct the sill segment. After the concrete has been set, the forms are withdrawn and the interior of the cofferdam is flooded with water. Next, the cofferdam is repositioned along the length of the segment of the sill by pumping water out of the first chamber and floating the sill for lateral displacement.

Of course, in the event that the sill under construction is designed to have a hollow structure, as shown for example in FIG. 4, it is necessary to place bulkheads at the end of a completed sill segment prior to flooding the interior of the cofferdam shell. Once the shell has been repositioned to construct the next segment, the interior of the cofferdam shell is evacuated or dewatered, and the bulkheads are removed before the next sill segment is constructed.

In this manner, the sill is constructed in segments as the mobile cofferdam is displaced laterally along the length of previously constructed sill segments as shown in FIGS. 1 and 4. For example, approximately 100 feet of sill or wall are constructed during each cycle. At the leading end, approximately 50 feet of the structure will be built, from driving piles if required, through placing the concrete. Immediately behind that, on the previously built 50 foot section, the remaining structural appurtenances 30, wickets 32, and operating equipment 34 for the the sill are installed. The mobile cofferdam is anchored to the section during the dewatered period to resist the unbalanced hydrostatic forces between the leading and trailing ends thereof.

Using the inventive method and mobile cofferdam structure, substantial cost savings are provided. Moreover, in rivers a smaller restriction of flow area than is necessary with conventional cofferdam construction allows concurrent construction of structures and shortens the overall project construction time. Environmental disturbance is also minimized when compared with conventional cofferdam construction, which requires moving more material to fill cells and construct berms, and results in greater noise and activity associated with placing and pulling the cells. The placement of concrete for construction of the sill is accomplished with a mechanized repetitive slip-form technology for increased efficiency. Finally, since a small area is dewatered at any given time, the total pumping requirements are less than with conventional technology.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A method for building elongated structures in a body of water, comprising the steps of (a) positioning a mobile cofferdam at the bottom of a body of water, said mobile cofferdam having one side wall contoured to match the contour of the structure being built;

(b) removing the water from the interior of the cofferdam;

(c) assembling a segment of the structure on the bottom of the body of water within the cofferdam;

(d) flooding the interior of the cofferdam;

(e) repositioning the cofferdam along the length of the structure segment at the bottom of the body of water with said contoured side wall mating with the segment;

(f) anchoring the cofferdam in a construction position; and (g) repeating steps (b) through (f) until the elongated structure has been completed.

2. A method as defined in claim 1, wherein said mobile cofferdam includes inner and outer perimeter walls defining a chamber, and further wherein said positioning and repositioning steps include floating and sinking said cofferdam by removing and adding water to said chamber, respectively.

3. A method as defined in claim 2, and further comprising the step of removing water from the soil at the bottom of the body of water.

4. A method as defined in claim 3 wherein said anchoring step includes extending gripping devices from said cofferdam which engage the segment.

5. A method as defined in claim 3, wherein said anchoring step includes pumping concrete into the interior of the cofferdam following said repositioning step to construct a concrete base which prevents said cofferdam from shifting during said assembly step.

6. A method as defined in claim 3, and further comprising the step of sealing the cofferdam to a previously constructed segment prior to removing water from the interior of the cofferdam.

7. A method as defined in claim 6, and further comprising the step of constructing a bulkhead on the segment following assembly.

8. A mobile cofferdam for use in building an elongated structure on the bottom of a body of water, comprising (a) a rectangular shell including spaced inner and outer walls defining a first chamber therebetween, the interior of said shell comprising a second chamber;

(b) a bottom wall connected with the bottom edges of said inner and outer walls for closing the bottom of said first chamber;

(c) pumping means connected with said shell for adding and removing water relative to said first and second chambers, whereby when water is removed from said second chamber, a construction area for building a segment of the elongated structure is defined and when water is removed from said first chamber, the shell is floated for repositioning with respect to a previously built segment of the structure; and (d) means for anchoring the shell to the previously built segment of the structure; and (e) wherein one side wall of said shell is contoured to match the contour of the structure under construction; and (f) wherein said contoured wall includes a seal for engagement with the previously built segment of the structure; and (g) further comprising hydraulically actuated forms connected with said shell, said forms being positioned to receive concrete for construction of a segment of the structure.

9. A cofferdam as defined in claim 8, wherein said anchoring means comprise hydraulically actuated plungers connected with said shell for gripping a previously built segment of the structure.

* * * * *